US012808566B1

(12) United States Patent
Perrone, Jr.

(10) Patent No.: US 12,808,566 B1
(45) Date of Patent: Nov. 24, 2026

(54) EFFICIENT AIR CONDITIONING SYSTEM

(71) Applicant: Thomas A Perrone, Jr., North Richland Hills, TX (US)

(72) Inventor: Thomas A Perrone, Jr., North Richland Hills, TX (US)

( * ) Notice: Subject to any disclaimer, the term of this patent is extended or adjusted under 35 U.S.C. 154(b) by 140 days.

(21) Appl. No.: 18/799,752

(22) Filed: Aug. 9, 2024

Related U.S. Application Data

(63) Continuation-in-part of application No. 18/392,992, filed on Dec. 21, 2023, now abandoned.

(51) Int. Cl.
*F24F 11/84* (2018.01)
*F24F 1/032* (2019.01)

(52) U.S. Cl.
CPC ..... *F24F 11/84* (2018.01); *F24F 1/032* (2019.02)

(58) Field of Classification Search
CPC .... F24F 11/84; F24F 1/032; F24F 1/00; F24F 40/00; F24F 40/02
See application file for complete search history.

(56) References Cited

U.S. PATENT DOCUMENTS

2012/0272669 A1* 11/2012 Blanton ..... F25D 17/06 62/89
2024/0167718 A1* 5/2024 Xiao ..... F25B 6/04

* cited by examiner

*Primary Examiner* — Miguel A Diaz
(74) *Attorney, Agent, or Firm* — Richard Eldredge; Leavitt Eldredge Law Firm

(57) ABSTRACT

An efficient air conditioning system optimizes heat absorption and rejection in a thermodynamic cycle using a specific sequence of components. Employing a series of heat exchangers, the system enhances subcooling of a liquid refrigerant post-condensation, leading to a marked decrease in inlet temperature and enthalpy as it enters the main metering device immediately upstream of the evaporator. Such arrangements facilitate a greater heat absorption rate at the evaporator, thereby elevating the efficiency of the air conditioning cycle.

4 Claims, 4 Drawing Sheets

EFFICIENT AIR CONDITIONING SYSTEM

BACKGROUND

1. Field of the Invention

The present invention relates generally to air conditioning systems, and more specifically to an air conditioning system that utilizes a sequential subcooling process for a liquid line flow prior to metering for enhanced thermodynamic efficiency.

2. Description of Related Art

Air conditioning systems are well known in the art and are effective means to move heat from an indoor, enclosed space to the outside. For example, FIG. 1 depicts a conventional air conditioning system 101 having a compressor 103, condenser 105, metering device 106, and evaporator 107 arranged in a cycle using a fluid such as refrigerant that passes through each to move heat from one space (where the evaporator is located) to another (where the condenser is located).

One of the problems commonly associated with system 101 is limited ability to subcool the liquid line flow exiting the condenser 105, which may not cool significantly below the saturation temperature at the given discharge pressure of the system. This keeps the enthalpy entering the metering device 106 elevated and leaves less ability for the evaporator 107 to absorb heat from the indoor space.

Accordingly, although great strides have been made in the area of air conditioning systems, many shortcomings remain. It is therefore an object of the present invention to provide an air conditioning system that achieves enhanced subcooling prior to metering for enhanced efficiency.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
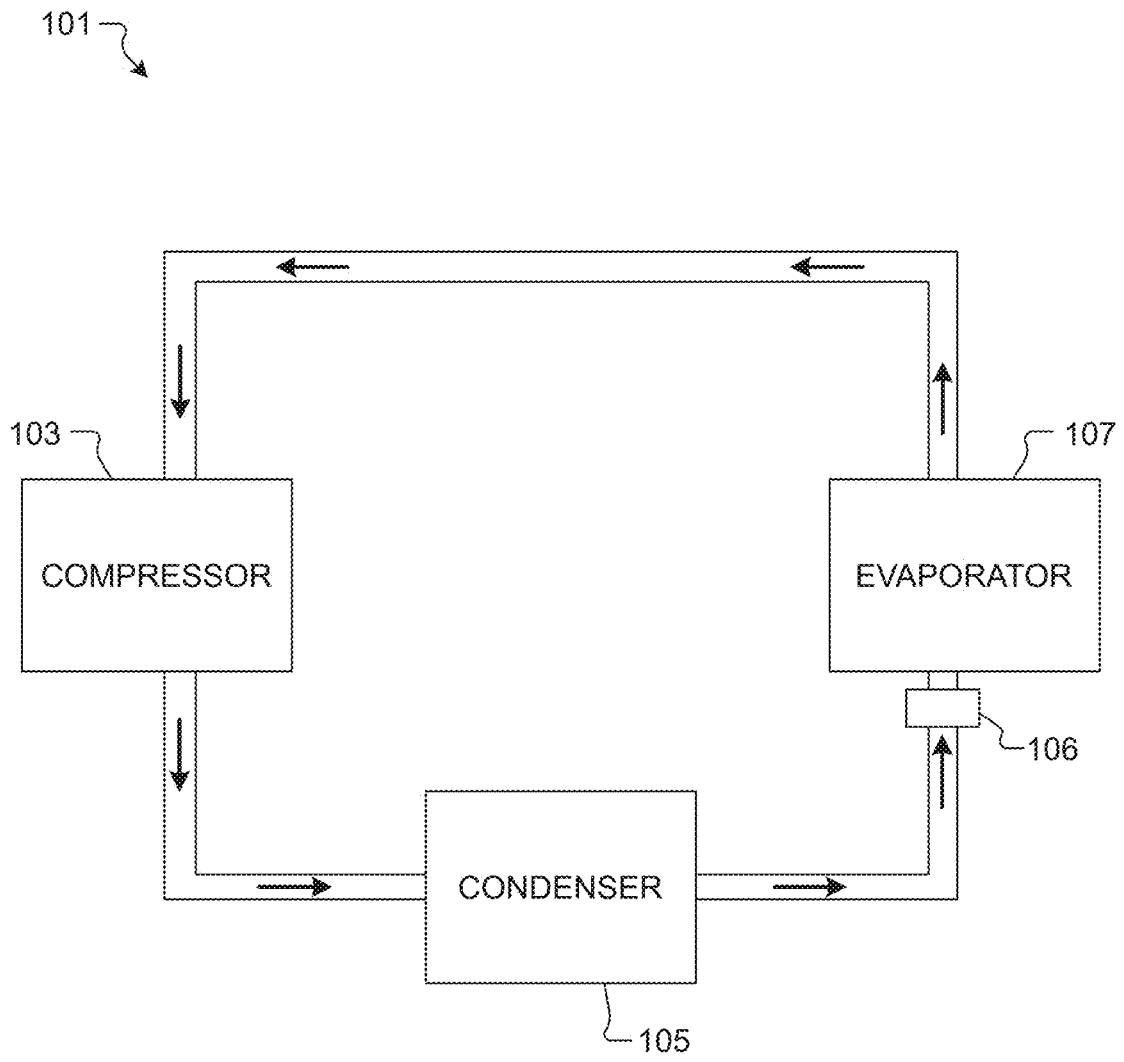
FIG. 1 Prior Art
FIG. 1 is a diagram of a common air conditioning system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional air conditioning systems. Specifically, the system of the present invention utilizes a sequential subcooling process for the liquid line flow prior to metering, enhancing the thermodynamic efficiency and effectiveness of the cooling process. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
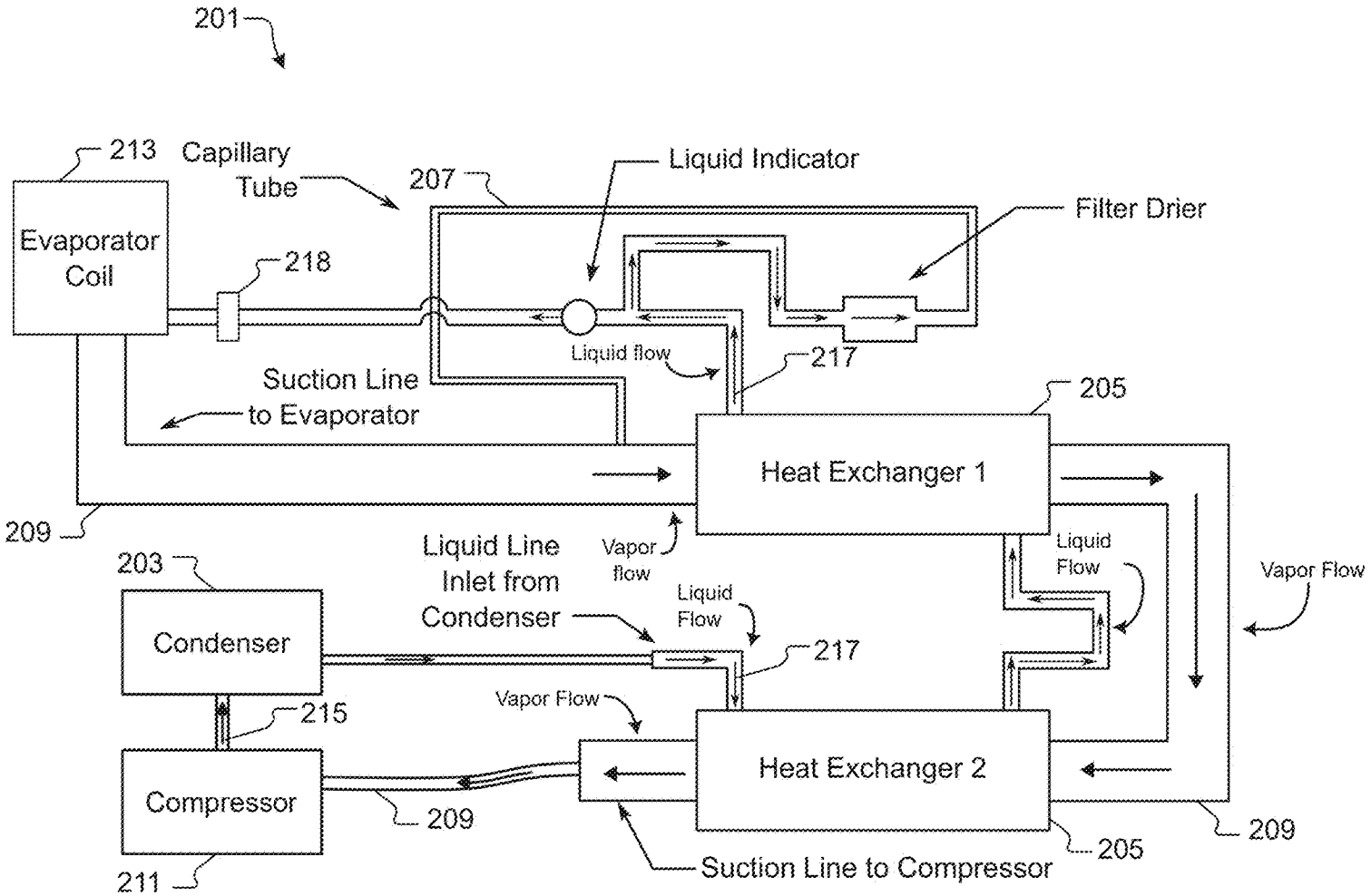
FIG. 2 is a diagram of an efficient air conditioning system in accordance with a first preferred embodiment of the present application.
Figure 3:
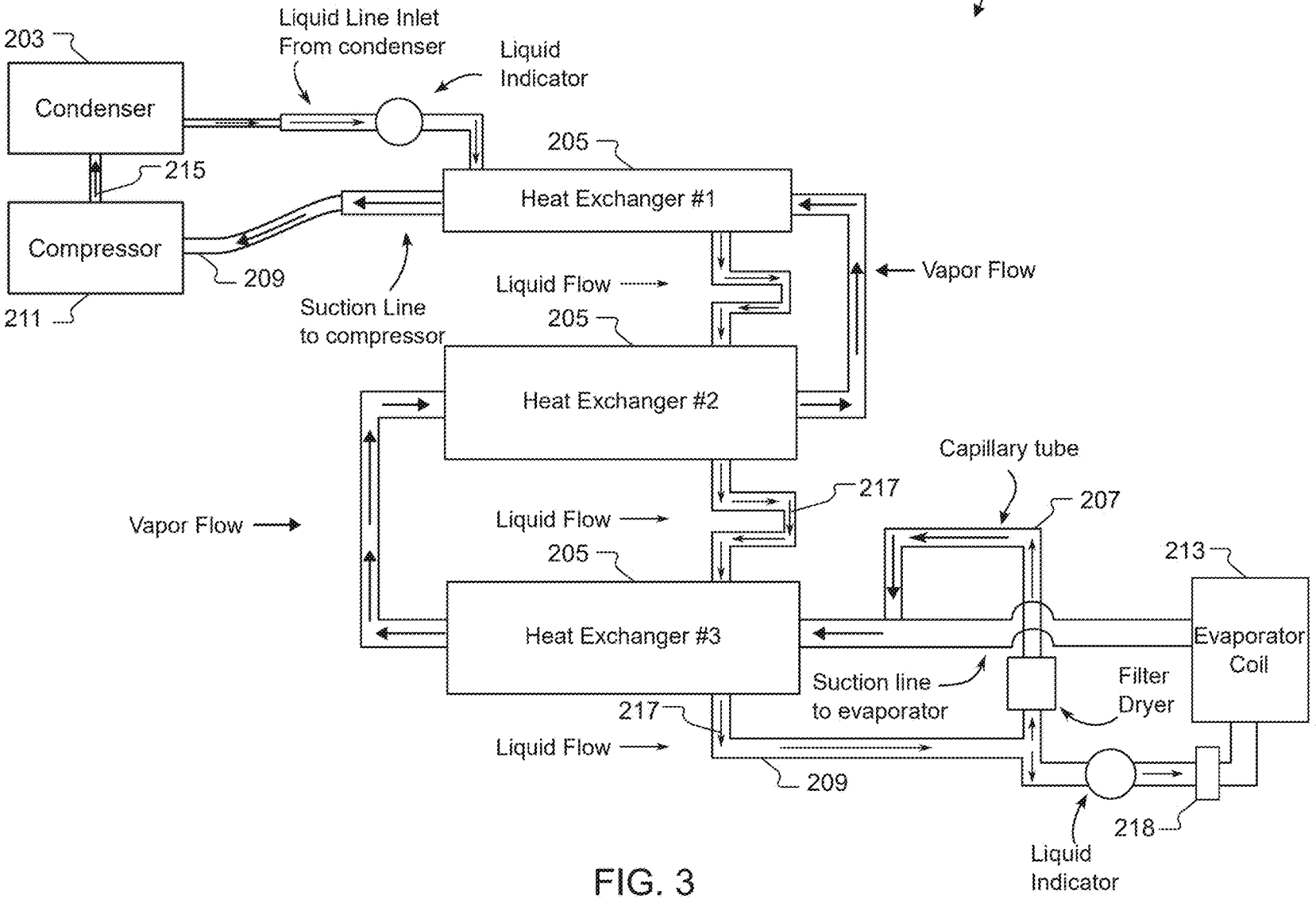
FIG. 3 is a diagram of an efficient air conditioning system in accordance with a second preferred embodiment of the present application.

Referring now to the drawings wherein like reference characters identify corresponding or similar elements throughout the several views, FIGS. 2-3 depict diagrams of a first, or stage 1, embodiment and a second, or stage 2, embodiment of an efficient air conditioning system 201 in accordance with a preferred embodiment of the present application. It will be appreciated that system 201 overcomes one or more of the above-listed problems commonly associated with conventional air conditioning systems. In addition, it should be appreciated that more or fewer of such components may be included in different embodiments of the system 201.

In the contemplated embodiment, system 201 includes a condenser 203, a plurality of heat exchangers 205, and metering devices 207 and 218 all in fluid communication via tubes 209 and a fluid such as, but not limited to refrigerant. It will be appreciated that the present invention is based on the refrigeration cycle, and the contemplated embodiment further comprises a compressor 211 and an evaporator 213.

However, it should be understood that the present invention may be utilized with any applicable thermodynamic cycle or other suitable application.

The condenser 203 is configured to receive a high-pressure vapor flow 215, convert the high-pressure vapor flow 215 to a liquid line flow 217, and output the liquid line flow 217. The liquid line flow 217 is configured to sequentially pass through the plurality of heat exchangers 205 and also to the metering device 207 downstream of the heat exchangers 205 and also through the liquid indicator. In some embodiments, the metering device 207 may be a capillary tube. In some embodiments, the metering device 207 may be a thermostatic expansion valve (TXV).

The heat exchangers 205 are configured to subcool the liquid line flow 217 prior to encountering the metering devices 207 and 218. Further cooling the liquid line 217 after leaving the condenser 203 results in a further reduction of enthalpy entering the main metering device 218 that is located between the liquid indicator and the evaporator 213 as well as the enthalpy entering the metering device 207. Each heat exchanger further reduces the temperature of the liquid line flow 217, directly correlating with improved efficiency via a higher heat absorption rate by the evaporator 213. This also achieves a lower evaporator temperature, allowing for the evaporator coil 213 to condense additional moisture from the incoming air for greater dehumidification.

The metering device 218 is configured to convert the subcooled liquid line flow 217 to a low-pressure vapor flow 209, as typical in the refrigeration cycle. The evaporator 213 is configured to receive the low-pressure vapor flow from the metering device 218 and facilitate absorption of heat therefrom. In some embodiments, the heat exchangers 205 will function as a liquid subcooler. The reduction in enthalpy produced by passing the liquid line 217 through the heat exchangers 205 between the condenser 203 and the metering device 207 results in decreased enthalpy entering the metering device 218 and then the evaporator 213, and thus increasing the rate of heat absorption and humidity removal by the evaporator 213 and increasing the efficiency of the system 201.

Figure 4:
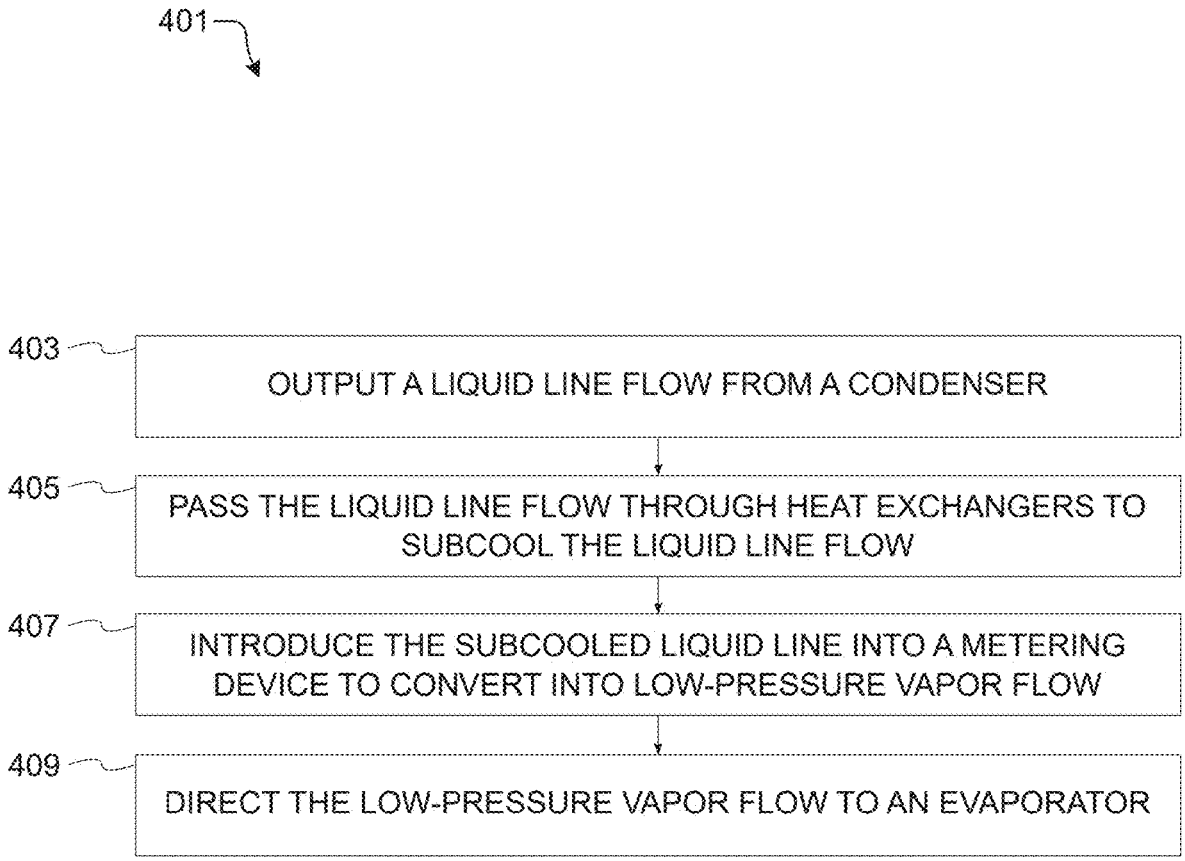
FIG. 4 is a flowchart of the preferred method of use of the system of FIGS. 2-3.

FIG. 4 depicts a method of use 401 for the system of FIGS. 2-3 in accordance with an embodiment of the present invention. The method 401 initiates with step 403 of outputting a liquid line flow from a condenser. The method 401 further includes a step 405 of passing the liquid line flow through multiple heat exchangers to subcool the liquid line flow. Subsequently, the subcooled liquid line is introduced into the main metering device to be converted into low-pressure vapor flow 407. Finally, the low-pressure vapor flow is directed to an evaporator 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An air conditioning system comprising:

a metering device comprising an expansion device selected from the group consisting of a capillary tube and a thermostatic expansion valve;

a heat exchanger;

a condenser in communication with both the metering device and the heat exchanger, the condenser is configured to convert a high-pressure vapor flow to a liquid line flow and output the liquid line flow, the liquid line flow configured to sequentially pass through the heat exchanger and the metering device, the metering device is positioned downstream of the heat exchanger;

wherein the heat exchanger positioned in a liquid line between the condenser and the metering device and is configured to subcool the liquid line flow prior to encountering the metering device; and wherein the metering device is configured to convert the liquid line flow to a two-phase low-pressure refrigerant flow;

an evaporator configured to receive the two-phase low-pressure refrigerant flow and facilitate absorption of heat therefrom; and a plurality of additional heat exchangers positioned in the liquid line between the condenser and the metering device;

wherein the heat exchanger and the plurality of additional heat exchangers are connected in series by one or more connecting tubes carrying the liquid line flow therebetween; and wherein the liquid line flow is configured to sequentially pass through the heat exchanger and the plurality of additional heat exchangers prior to encountering the metering device such that each heat exchanger further subcools the liquid line flow.

2. The system of claim 1, further comprising an additional metering device positioned in parallel with the metering device, wherein the additional metering device is a capillary tube.

3. The system of claim 1, further comprising an additional metering device positioned in parallel with the metering device, wherein the additional metering device is a thermostatic expansion valve.

4. A method of cooling an environment, the method comprising the steps of:

providing the system of claim 1;

outputting the liquid line flow from the condenser;

sequentially passing the liquid line flow through the heat exchanger and the plurality of additional heat exchangers connected in series by one or more connecting tubes to progressively subcool the liquid line flow prior to expansion;

passing the liquid line flow into the metering device to convert the liquid line flow; and directing a two-phase low-pressure refrigerant flow to the evaporator to facilitate absorption of heat therefrom.

* * * * *